US009789346B1

(12) United States Patent
Kime

(10) Patent No.: US 9,789,346 B1
(45) Date of Patent: Oct. 17, 2017

(54) HANDSTAND PUSHUP DEVICE

(71) Applicant: Justin Kime, Huntington Beach, CA (US)

(72) Inventor: Justin Kime, Huntington Beach, CA (US)

( * ) Notice: Subject to any disclaimer, the term of this patent is extended or adjusted under 35 U.S.C. 154(b) by 0 days.

(21) Appl. No.: 15/000,908

(22) Filed: Jan. 19, 2016

(51) Int. Cl.
*A63B 21/00* (2006.01)
*A63B 23/02* (2006.01)
*A63B 23/035* (2006.01)

(52) U.S. Cl.
CPC .... *A63B 21/0005* (2013.01); *A63B 21/00047* (2013.01); *A63B 23/0233* (2013.01); *A63B 23/03525* (2013.01)

(58) Field of Classification Search
USPC ..... 482/1–148
See application file for complete search history.

(56) References Cited

U.S. PATENT DOCUMENTS 3,912,262 A * 10/1975 Micko ..... A63B 21/0004 273/449
4,358,106 A 11/1982 Shadford
4,410,174 A * 10/1983 Hamada ..... A63B 21/00047 206/315.1
5,205,802 A * 4/1993 Swisher ..... A63B 21/00047 482/100
5,421,800 A 6/1995 Mullen
5,643,162 A * 7/1997 Landers ..... A63B 21/154 482/131
6,129,651 A 10/2000 Denaro
7,824,319 B2 11/2010 Carlesimo et al.
7,909,746 B2 3/2011 Gant
9,211,437 B2 * 12/2015 Soba ..... A63B 21/151
9,278,242 B2 * 3/2016 Winn ..... A63B 5/12
2012/0316043 A1 12/2012 Mangalindan
2013/0324382 A1 * 12/2013 Wilson ..... A61H 7/007 482/142
2014/0141949 A1 5/2014 Mills et al.
2014/0171278 A1 6/2014 Orenstein
2015/0051057 A1 2/2015 Carter et al.
2015/0072842 A1 3/2015 Segal
2016/0143444 A1 * 5/2016 Lan ..... A47C 9/002 297/183.9

* cited by examiner

*Primary Examiner* — Stephen R Crow
(74) *Attorney, Agent, or Firm* — Eric Karich; Karich & Associates

(57) ABSTRACT

A handstand pushup device has a central body portion that includes a padded cushion, and two handplates, positioned laterally on opposite sides of the central body portion. Each of the handplates has a flat upper surface that is slip resistant. Two elongate blocks are also provided, each of the elongate blocks having a bottom surface and an inner surface. The bottom surface interlocks with the one of the handplates for removably mounting the elongate block on the handplate. The inner surface of the elongate blocks limits the placement of a user's hands while performing handstand pushups using the device, so that the user's hands are not placed too far apart when performing the handstand pushups.

15 Claims, 8 Drawing Sheets

HANDSTAND PUSHUP DEVICE

BACKGROUND OF THE INVENTION

Field of the Invention

This invention relates generally to exercise and fitness equipment, and more particularly to a handstand pushup device.

Description of Related Art

The prior art teaches a wide range of exercise and fitness equipment for performing standard pushups, in which the person is in a generally horizontal position, and raises and lowers only his or her upper body. While there are some similarities between these devices and the present invention, there are many important differences that arise due to the different use of the present invention for handstand pushups rather than regular pushups.

Orenstein, U.S. 2014/0171278, for example, teaches a push up device that includes a base for positioning on the floor, side supports and a centrally mounted push up counter. Hand supports extend from opposite sides of the support device. In one embodiment, the hand supports are removably mounted from the support device.

Carlesimo, U.S. Pat. No. 7,824,319, teaches a push up system that includes multiple stackable plates that form adjustable columns for adjusting the height of the user's hands while performing pushups.

Landers, U.S. Pat. No. 5,643,162, teaches a pushup exercise apparatus that includes rolling grips mounted on elongate blocks on either side of a padded center cushion. The rolling grips may include wheels located rotatably on a handle shaft, and may be engaged with stops on the elongate block guides for fixing the distance along which the rolling grips are permitted to move within the guide. The rolling grips of this device would not be suitable for handstand pushups, which require a flat, non-slip surface on either side of the center pad.

Mullen, U.S. Pat. No. 5,421,800, teaches a pushup device that includes a centrally located padded portion mounted on springs, and rings on either side for the user to grip while performing pushups. In this device, the padded portion pushes upwardly on the user's chest to facilitate the pushups. In a second embodiment, shown in FIG. 8, plates are located on either side of the device for the user to push against; however, in this embodiment, the central portion is a metal plate without padding.

Mills, U.S. 20140141949, teaches an exercise device for performing pushups. The device includes a hinge and a pair of guide tracks, each guide track attached to a corresponding side of the hinge. Each guide track includes a central longitudinal slot formed in the guide track, the slot having a plurality of stop positions formed therein, a rotatable pushup handle assembly slidable over the slot between stop positions, and a locking device insertable into a portion of the rotatable pushup handle assembly to lock a lower portion of the rotatable pushup handle assembly in one of the stop positions in the slot, an upper portion of the rotatable pushup assembly still able to rotate while the assembly is in a locked condition.

The prior art teaches various devices that are adapted for performing standard, horizontal pushups. However, the prior art does not teach a handstand pushup device that is adapted for performing handstand pushups, and including elongate blocks for restricting the placement of the user's hands upon the handplates. The present invention fulfills these needs and provides further advantages as described in the following summary.

SUMMARY OF THE INVENTION

The present invention teaches certain benefits in construction and use which give rise to the objectives described below.

The present invention provides a handstand pushup device having a central body portion comprising a padded cushion, and two handplates, positioned laterally on opposite sides of the central body portion, each of the handplates having a flat upper surface that is slip resistant. A first interlocking feature is formed in each of the handplates. Two elongate blocks are also provided, each of the elongate blocks having a bottom surface and an inner surface. The bottom surface has a second interlocking feature that interlocks with the first interlocking feature of one of the handplates for removably mounting the elongate block on the handplate. The inner surface of the elongate blocks limits the placement of a user's hands while performing handstand pushups using the device, so that the user's hands are not placed too far apart when performing the handstand pushups.

A primary objective of the present invention is to provide a handstand pushup device having advantages not taught by the prior art.

Another objective is to provide a handstand pushup device that is particularly constructed for performing handstand pushups rather than the more common form of pushups.

Another objective is to provide a handstand pushup device that includes elongate blocks that restrict the placement of the user's hands while performing the handstand pushups, so that the user's hands may not be placed too far apart.

Another objective is to provide a handstand pushup device that includes a padded center portion for receiving the user's head while performing the handstand pushups.

Another objective is to provide a handstand pushup device that includes handplates that provide suitably flat, non-slip surfaces for the user to place his or her hands during the handstand pushups.

A further objective is to provide a handstand pushup device that provides handplates that are adjustable in height relative to the padded center cushion, for adjusting the difficulty of the handstand pushups.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a handstand pushup device 10 for performing handstand pushups.

Figure 1:
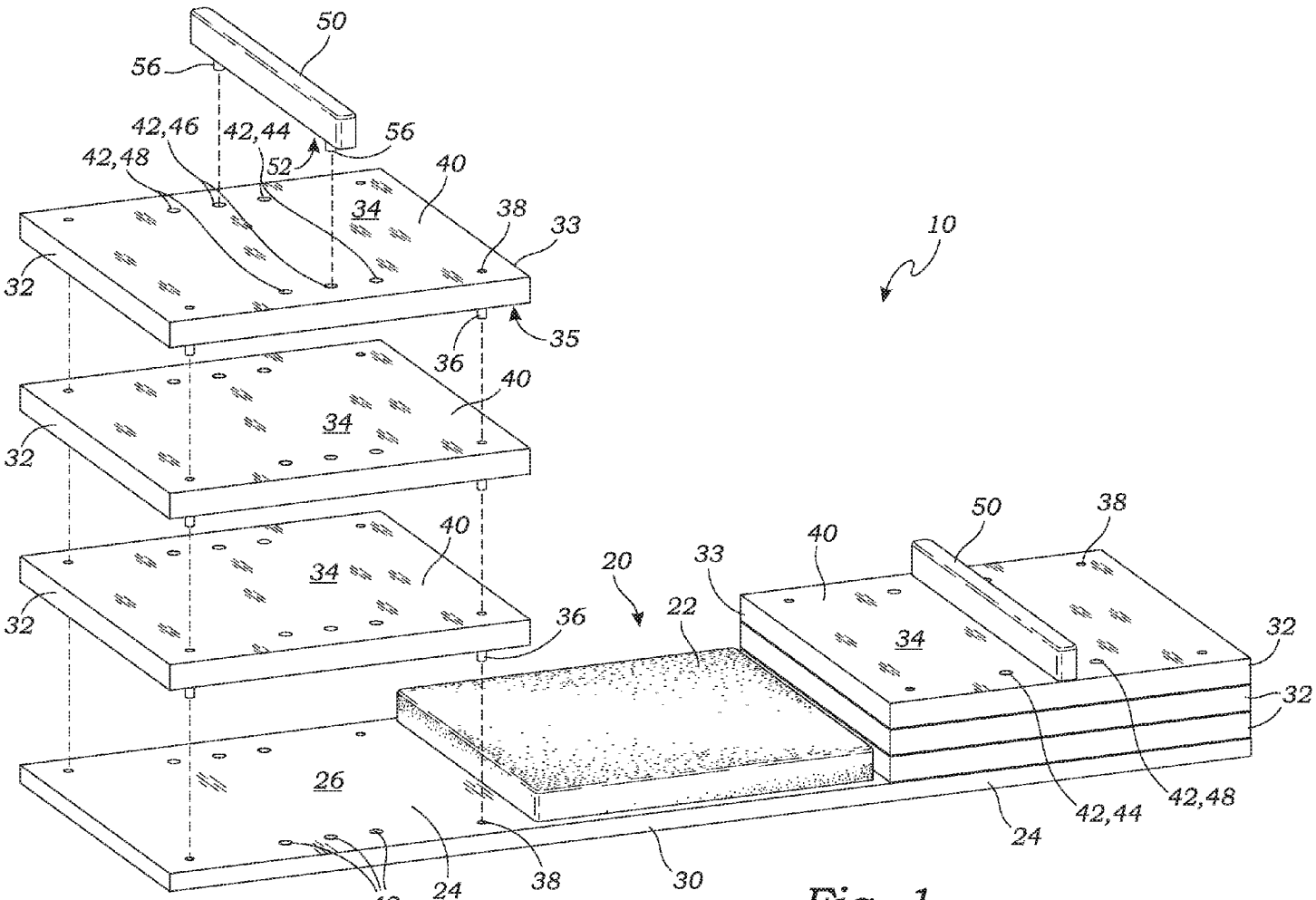
FIG. 1 is an exploded perspective view of a handstand pushup device according to one embodiment of the present invention, illustrating the device with multiple stacked plates on each side, and with an elongate block operably mounted on each of the top stacked plates.
Figure 2:
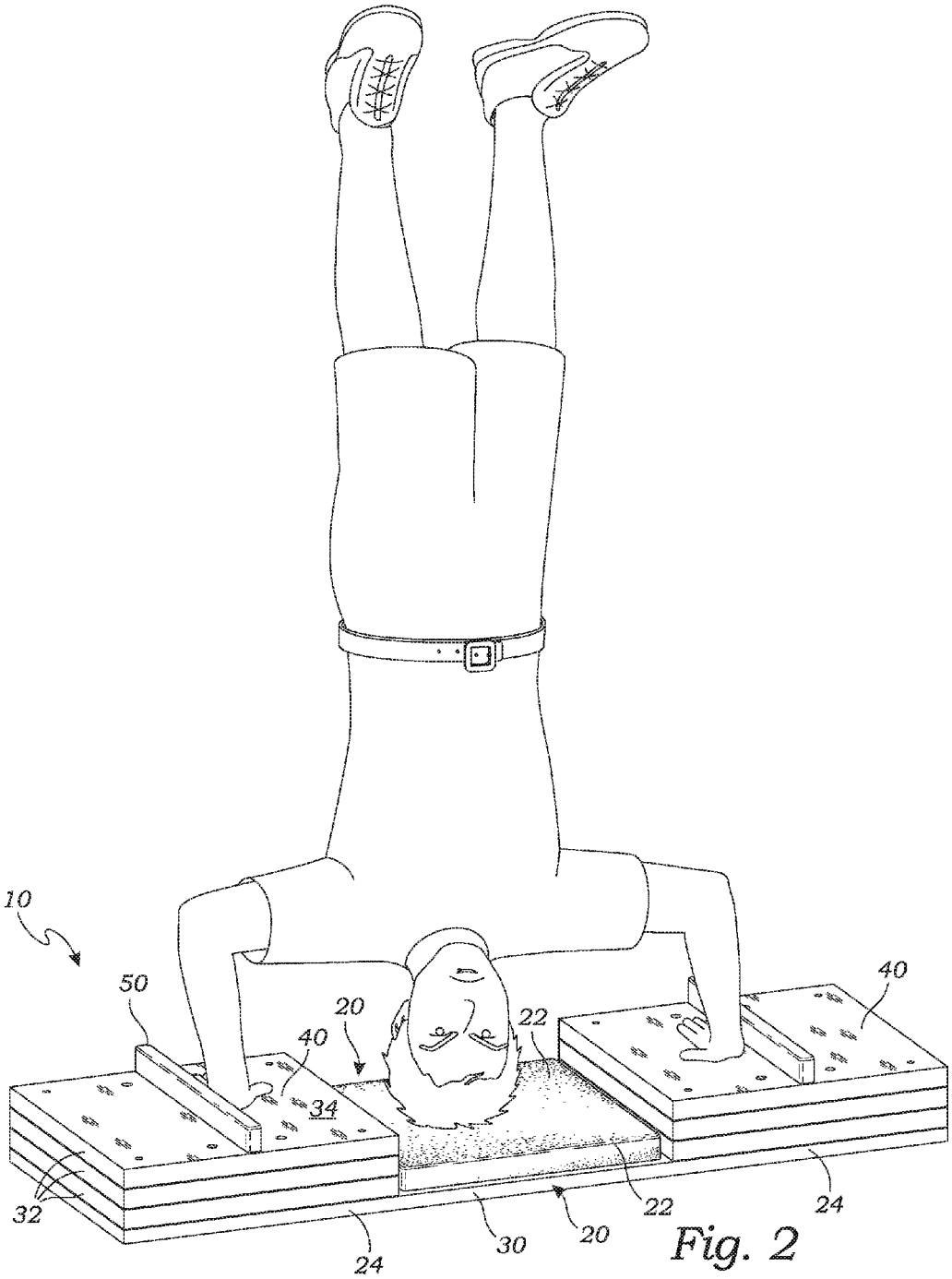
FIG. 2 is a perspective view thereof illustrating a user performing handstand pushups using the device.
Figure 3:
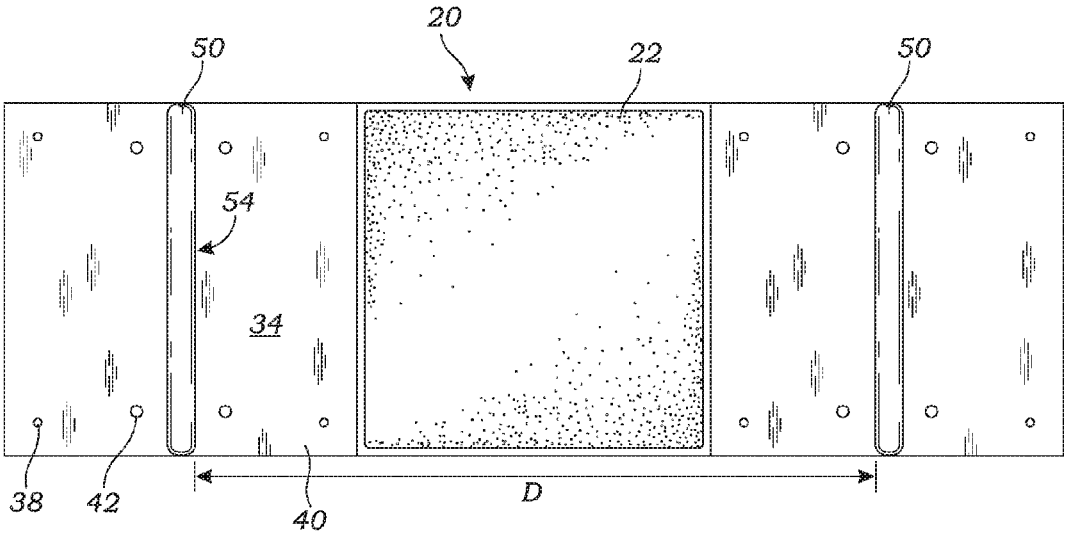
FIG. 3 is a top plan view of the handstand pushup device.
Figure 4:
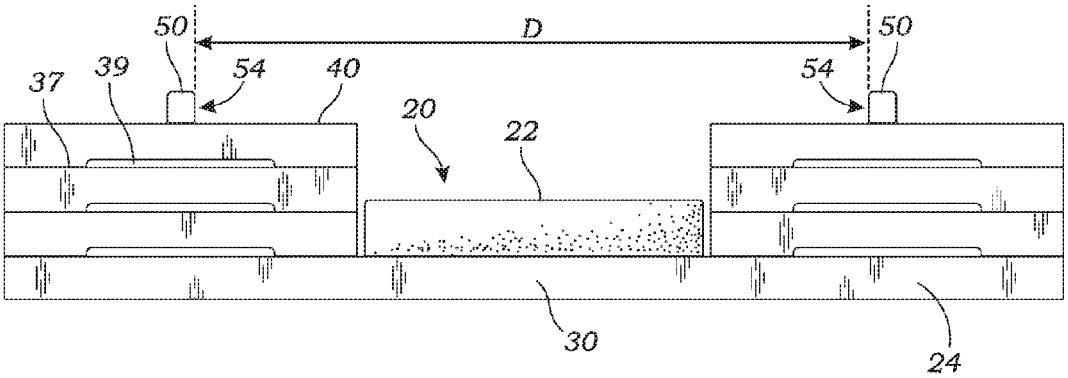
FIG. 4 is a rear elevational view thereof.

FIG. 1 is an exploded perspective view of the handstand pushup device 10 according to one embodiment of the present invention. FIG. 1 illustrates an embodiment of the device 10 with multiple stacked plates 32 on each side. FIG. 2 is a perspective view thereof illustrating a user performing handstand pushups using the device 10. FIG. 3 is a top plan view of the handstand pushup device 10, and FIG. 4 is a rear elevational view thereof.

As shown in FIGS. 1-4, the handstand pushup device 10 includes a central body portion 20 comprising a padded cushion 22, and two handplates 24 (or further handplates 40), positioned laterally on opposite sides of the central body portion 20. Each of the handplates 24 or 40 has a flat upper surface 26 or 34 that is smooth and slip resistant. The flat upper surface may include additional features, such as bores as described below, so long as these features do not interfere with the placement of the user's hands upon them during the handstand exercises.

In this embodiment, the handstand pushup device 10 includes a planar base 30 that comprises the central body portion 20 (the center of the planar base 30) and the two handplates 24 that are positioned laterally on opposite sides of the central body portion 20 (i.e., the side portions of the planar base 30). In this embodiment, the planar base 30 is in the form of a generally rectangular rigid construction, which may be made of any suitable material (e.g., metal, wood, plastic, etc.). The flat upper surface 26 or 34 may have any form of texturing, rubberized coating, slip resistant paint, or other treatment of covering, to provide a proper surface that is comfortable to the touch, but also provides a stable surface so that the user does not slip during a handstand. This must remain stable even if the user is wet with sweat.

The padded cushion 22 mounted on the central body portion 20 may be any form of suitable padding, foam rubber, cushion, or other structure known in the art for providing a suitably comfortable rest for the user's head during pushups. The padded cushion 22 must be large enough to support the user's head, while small enough to not interfere with the placement of the user's hands for the handstand exercises. The padded cushion 22 of this embodiment is a rectangular cuboid structure that is about 16 inches wide and 16 inches long, and thick enough to provide acceptable padding to the user's head. For purposes of this application, the term "about" (or "approximately") is defined to mean +/−10%.

Figure 5:
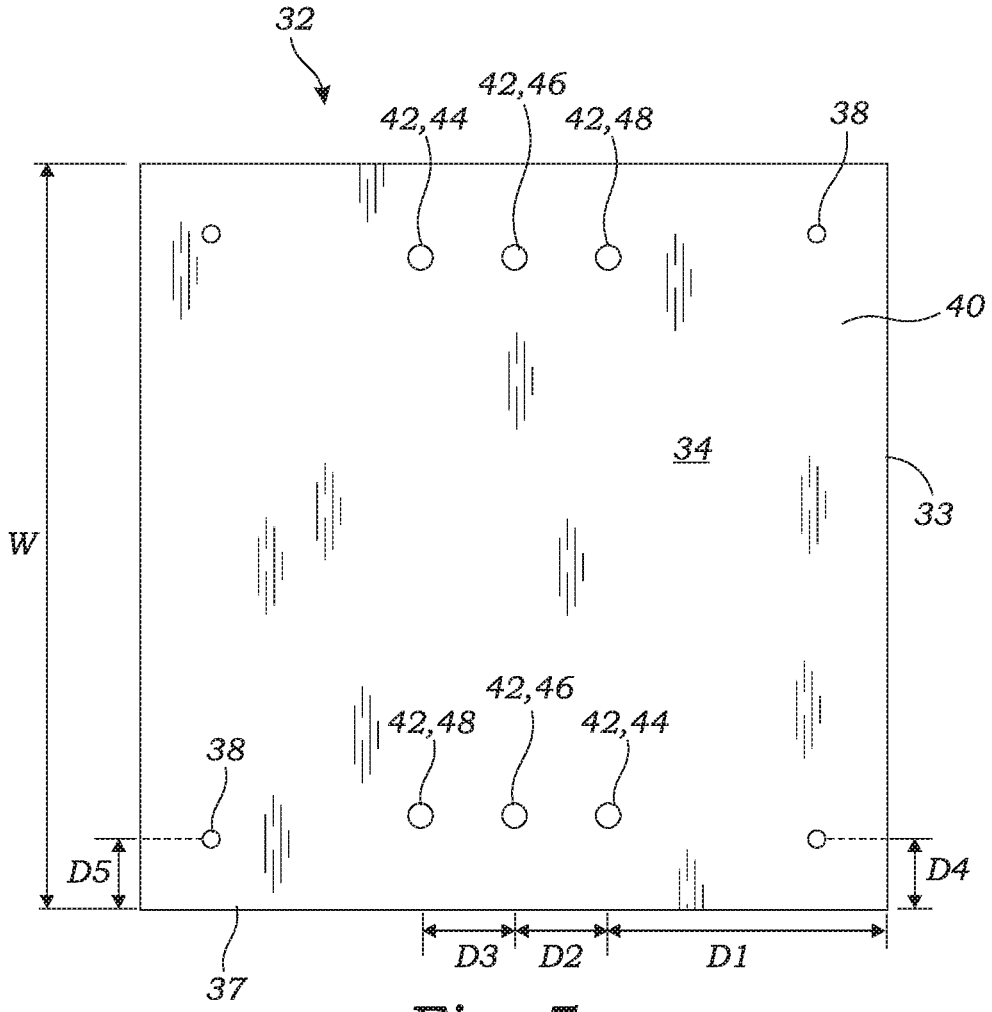
FIG. 5 is a top plan view of one of the stacked plates.

As discussed above, in this embodiment, the handstand pushup device 10 may further include multiple stacked plates 32 for the purpose of changing the elevation of the handplates 24 with respect to the padded cushion 22. FIG. 5 is a top plan view of one of the stacked plates 32. Adding more of the stacked plates 32, and increasing the elevation, makes the handstand pushups more difficult to perform, while removing them makes the exercise easier.

In the embodiment of FIGS. 1-5, each of the stacked plates 32 has a width W about 16 inches wide (and similarly 16 inches long), and in this case about 2 inches thick. Also in this embodiment, the inner pair 44 of the first interlocking features 42 are spaced a distance D1 from the inner edge 33 that is about 6 inches, while the middle pair 46 are a distance D2 that is about 2 inches from the inner pair 44, and the outer pair 48 are a distance D3 that is about 2 inches from the middle pair 46. All three 44, 46, 48 are a distance D4 that is about 2 inches from the edge 37. The other of each pair are similarly spaced from the opposite edge. Obviously, these measurements may be varied by one skilled in the art to make an equivalent product. Similarly, the bore 38 is spaced a distance D5 that is about 1.5 inches in this embodiment from both adjacent edges.

Each of the stacked plates 32 may include nesting posts 36 (in a bottom surface 35) and nesting bores 38 (in the top surface 34) that interlock when the stacked plates 32 are stacked on top of each other and on top of the handplates 24 of the planar base 30. While the illustrated posts 36 and bores 38 form one type of interlocking structure, other forms of equivalent interlocking structures may also be substituted, and any equivalent structure known in the art should be considered within the scope of the present invention.

Each of the stacked plates 32 includes a top surface 34 that forms a further handplate 40. The term "handplate," for purposes of this application, refers to the flat upper surface of whichever element is at the top of the device, providing a surface for the user's hands to be placed during the exercise (such as the stacked plate 32 that is at the top of the stack, or any form of base that is positioned beneath the stacked plates 32).

Each of the handplates 24 (and each of the further handplates 40) further include a first interlocking feature 42 formed in each of the handplates 24, and also formed in each of the stacked plates 32 that may be mounted on each of the handplates 24. In this embodiment, the first interlocking feature 42 is a pair of bores; and in particular, in this embodiment, there are three sets of such pairs of bores, so that multiple mounting locations may be selected from during use. The first interlocking feature 42 may alternatively be any other form of interlocking structure known in the art (e.g., any form of male/female interlocking, or equivalent forms of locking ridges, etc.).

In this embodiment, there is an inner pair 44 that is about 6 inches from an inner edge 33 of the handplate 24 (i.e., closest to the padded cushion 22); there is a middle pair 46 that is about 8 inches from the inner edge 33; and there is an outer pair 48 that is about 10 inches from the inner edge 33 of the handplate 24. This construction is discussed in greater detail below.

As shown in FIG. 4, each of the stacked plates 32 may further include an edge 37 that includes a finger groove 39, e.g., a miter or similar indentation, that enables the user to insert his or her fingers between the plates 32 for facilitating lifting each of the plates 32 from the stack.

The handstand pushup device 10 further includes two elongate blocks 50, each of the elongate blocks 50 having a bottom surface 52 and an inner surface 54. The bottom surface 52 has a second interlocking feature 56 that interlocks with the first interlocking feature 42 of one of the handplates 24 or 40 for removably mounting the elongate block 50 on the handplate 24 or 40. The second interlocking feature 56 may be a structure that interlocks with the first interlocking feature 42 (e.g., mating posts to fit into the bores, or any alternative structure known in the art).

Once the elongate blocks 50 are properly mounted, the inner surfaces 54 of the elongate blocks 50 are preferably parallel and paced a predetermined distance from each other, for spacing the user's hands a proper distance, laterally, from each other. In this embodiment, as shown in FIG. 4, when the middle pair 46 of the bores is used, the inner surfaces 54 are a distance D that is about 30 inches apart, which is an optimum position for handstand pushups. Obviously, alternative spacings (in this case, either 28 inches or 32 inches) may be selected by one skilled in the art, and such alternatives are within the scope of the present invention.

In the embodiment of FIGS. 1-4, when the elongate blocks 50 are mounted on the handplates 24 or 40, the inner surfaces 54 of the elongate blocks 50 perpendicular to the upper surfaces 26 or 34 of their respective handplate 24 or 40. In this embodiment, the inner surface 54 is preferably a smooth, unbroken surface that allows the user's hands to abut the inner surface 54 during handstands without snagging a finger on the surface, or otherwise being injured.

In use, as shown in FIG. 2 (and FIG. 9, as discussed below), stacks may be provided, such as the stacked plates 32, weights 74 (as described below), or other suitable object(s), and the handplates 24 or 40 are provided at the top of each stack, on either side of the cushion 22. Each of the elongate blocks 50 is then mounted on the handplates 24 or 40 such that the inner surfaces 54 of the elongate blocks 50 limit the placement of a user's hands while performing handstand pushups using the device, so that the user's hands are not placed too far apart when performing the handstand pushups.

The user is then able to perform a handstand, as shown in FIG. 2, such that the user's hands are placed on the handplates 24 or 40, his or her head is placed on the padded cushion 22, and his or her body and legs extend generally vertically into the air, and further such that the inner surfaces 54 of the elongate blocks 50 prevent the user from spreading his hands too far apart on the handplates 24. The user is then able to perform the handstand pushups, pushing with his or her hands to lift his or her body upwardly to raise his or her head off of the padded cushion 22.

For purposes of this application, geometric terms such as parallel, perpendicular, etc., are defined to mean approximately equal to the particular geometric relationship, as would be understood by one skilled in the art, and exact geometric precision is not required.

Figure 6:
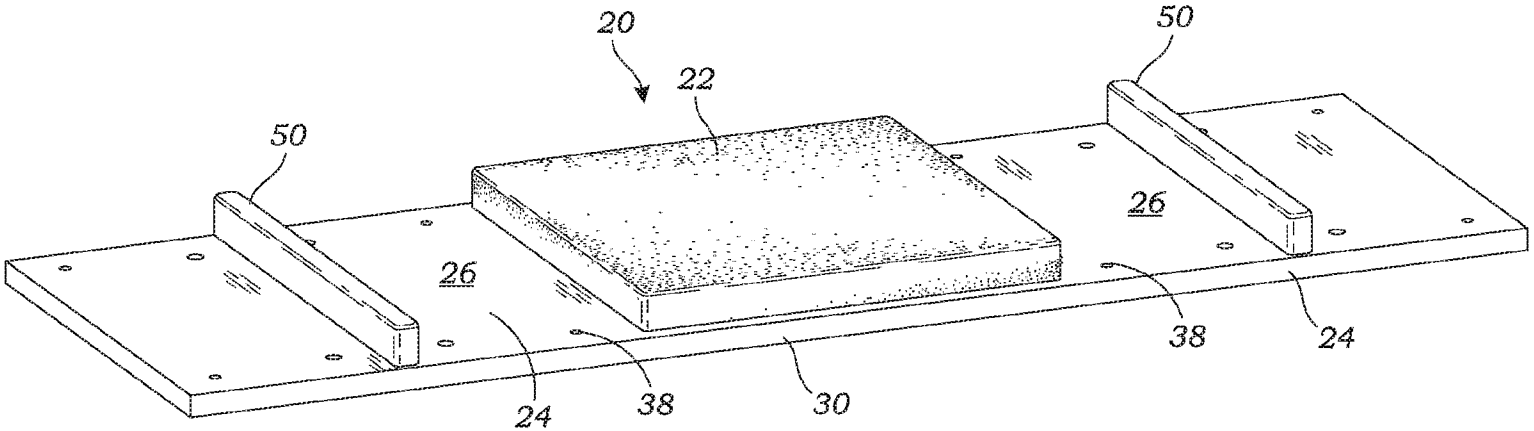
FIG. 6 is a perspective view of the handstand pushup device of FIG. 1, after the stacked plates have been removed, with the elongate blocks operably mounted on the lowest of the handplates.

FIG. 6 is a perspective view of the handstand pushup device 10 of FIG. 1, after the stacked plates 32 have been removed, with the elongate blocks 50 operably mounted on the lowest of the handplates 24. As illustrated in FIG. 6, it is possible to use the handstand pushup device 10 without any of the stacked plates 32, and the user simply places his or her hands directly on the planar base 30 in the suitable handplates 24 formed on the lateral sides of the planar base 30. The elongate blocks 50 are mounted in the same manner as described above. One or more of the stacked plates 32 may be added to make the handstand exercises progressively more difficult.

Figure 7:
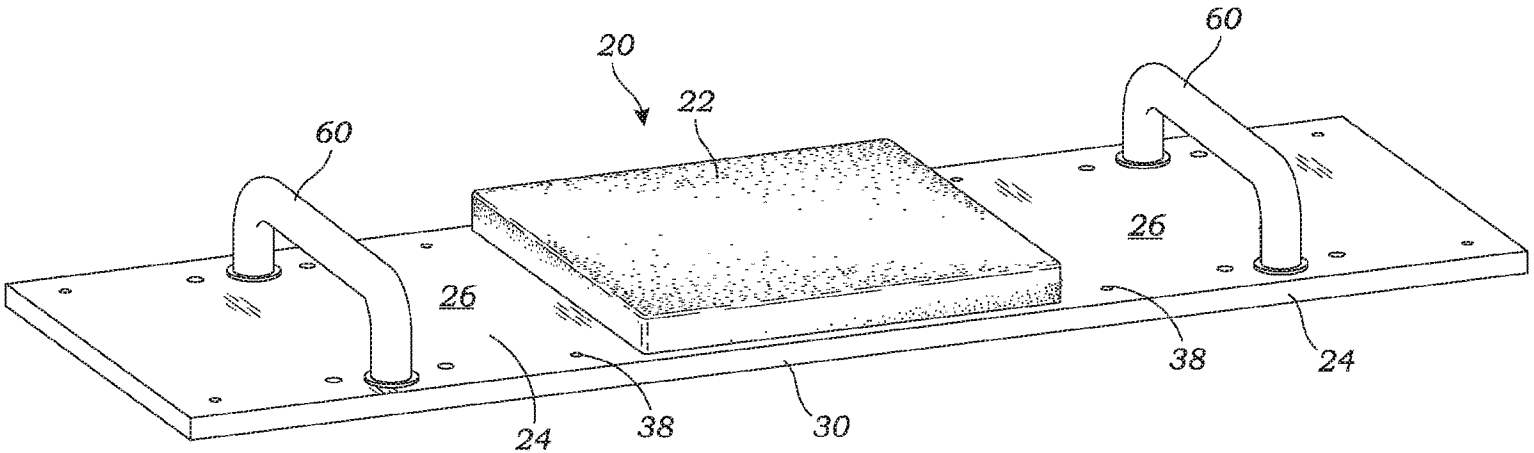
FIG. 7 is a perspective view of the handstand pushup device of FIG. 6, with the elongate blocks replaced with U-shaped exercise handles.

FIG. 7 is a perspective view of the handstand pushup device 10 of FIG. 6, with the elongate blocks 50 replaced with U-shaped exercise handles 60. As shown in FIG. 7, the elongate blocks 50 may be replaced in some circumstances to vary the handstands being performed. The U-shaped exercise handles 60 may be gripped to adjust the exercise as desired. For purposes of this application, the term "U-shaped" is defined to include any form of shape (e.g., curved, C-shaped, D-shaped, or equivalent shape) that may be gripped by the user so that his or her hand fits around or nearly around the structure.

Figure 8:
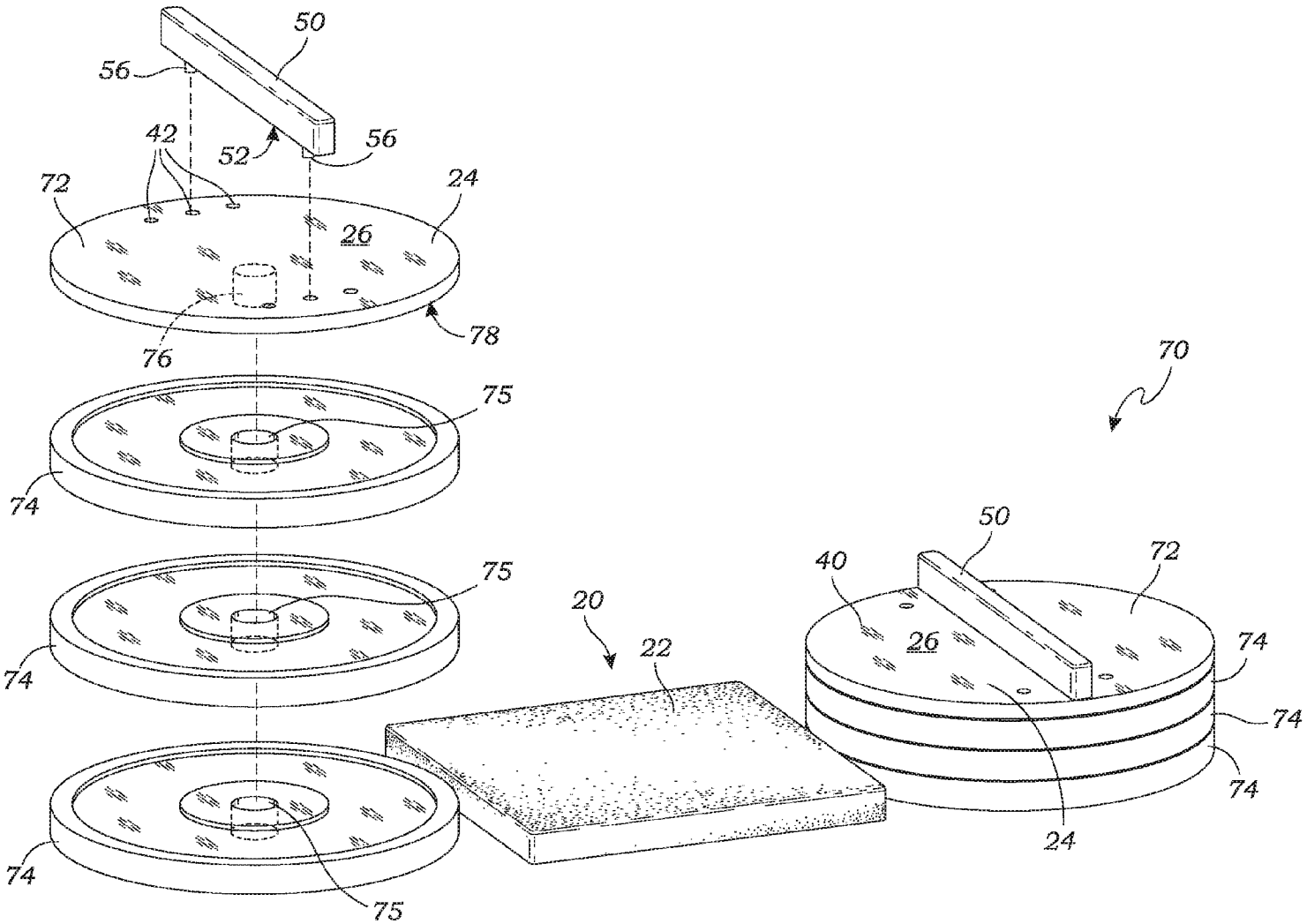
FIG. 8 is a perspective partially exploded view of a second embodiment of the handstand pushup device.
Figure 9:
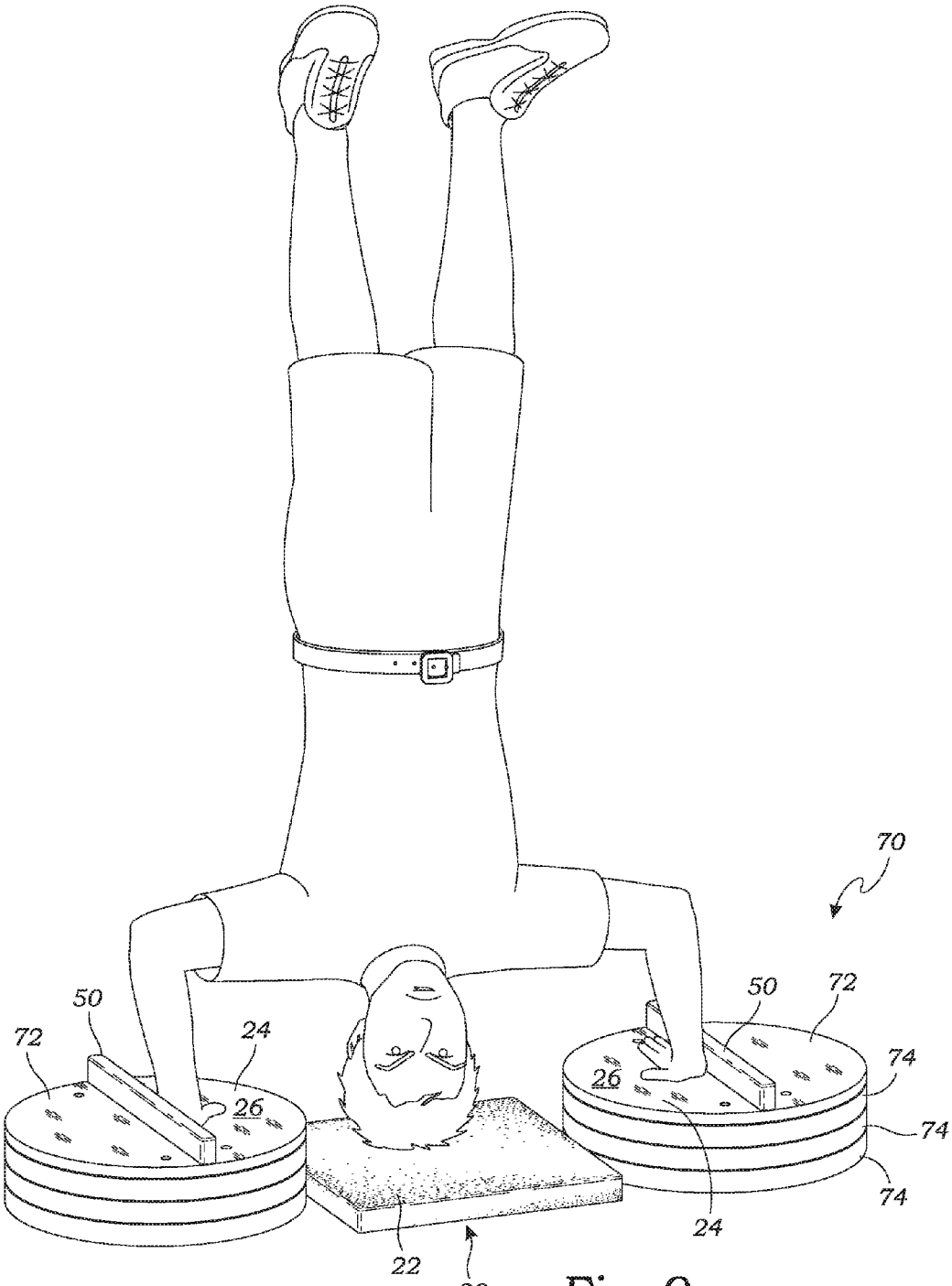
FIG. 9 is an perspective view thereof illustrating the user performing handstand pushups using the device.
Figure 10:
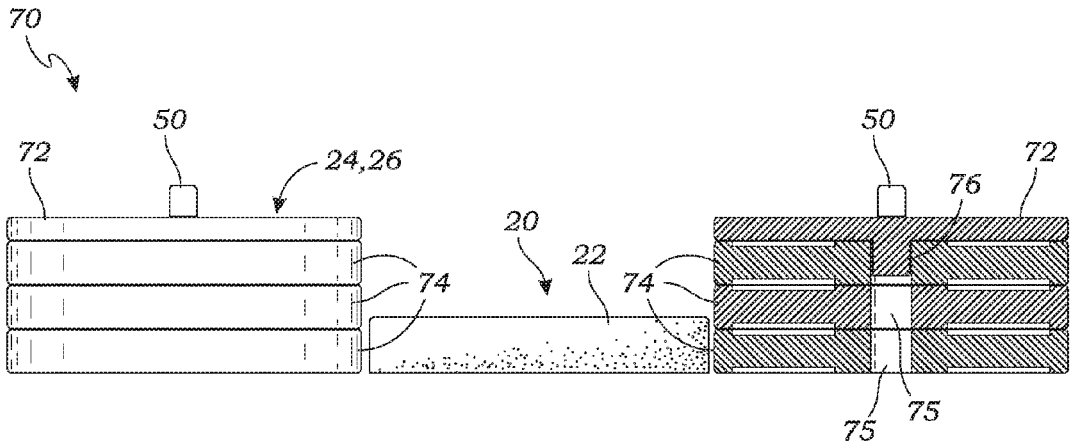
FIG. 10 is a front elevational view thereof, with one stack of weights being shown in cross-section to better illustrated the construction of the device 70.

FIG. 8 is a perspective partially exploded view of a second embodiment of the handstand pushup device 70. FIG. 9 is an perspective view thereof. FIG. 10 is a front elevational view thereof, with one stack of weights being shown in cross-section to better illustrated the construction of the device 70. As shown in FIGS. 8-10, it is not necessary that the planar base 30 be included, and instead the padded cushion 22 and the handplates 24 may be separate elements. In this case, the padded cushion 22 is a stand-alone cushion, and the handplates 24 are provided in the form of rigid plates 72 that are adapted to fit on a suitable object or surface.

In this embodiment, the rigid plates 72 are adapted to fit on top of weight plates 74, which are easily available in most gyms. The rigid plates 72 include a downwardly extending post 76 that extends from a bottom plate surface 78, for engaging the aperture 75 through the center of the weight plate 74. Alternatively, it may engage the out perimeter of the weight plate 74; however, this is less desirable, since the outer circumference is more variable than the aperture 75, which is standard to many bars. Other arrangements may be devised by those skilled in the art, and such alternatives should be considered within the scope of the present invention.

The rigid plates 72 each include nesting bores 80 and first interlocking feature 82 as described above, or equivalent features, and are therefore able to be used in the same manner as described above. In use, stacks are made of the weight plates 74 to the desired height, the rigid plates 72 are placed on top of the stack, and the elongate blocks 50 are mounted on the rigid plates 72, as described above.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A handstand pushup device comprising:

a central body portion comprising a padded cushion;

two handplates, positioned laterally on opposite sides of the central body portion, each of the handplates having a flat upper surface that is slip resistant;

a first interlocking feature formed in each of the handplates; and two elongate blocks, each of the elongate blocks having a bottom surface and an inner surface, the bottom surface having a second interlocking feature that interlocks with the first interlocking feature of one of the handplates for removably mounting the elongate block on the handplate, the inner surface limiting the placement of a user's hands while performing handstand pushups using the device, so that the user's hands are not placed too far apart when performing the handstand pushups; and wherein each of the handplates further comprises a plurality of stacked plates that each include nesting posts and nesting bores that interlock when the stacked plates are stacked on top of each other, with the handplate being formed by a top surface of a top one of the plurality of stacked plates.

2. The handstand pushup device of claim 1, wherein the elongate blocks are mounted on the handplates such that the inner surfaces of the elongate blocks are parallel to each other and placed a predetermined distance from each other.

3. The handstand pushup device of claim 2, wherein the inner surfaces of the elongate blocks are spaced a distance of about 30 inches from each other when mounted on the handplates.

4. The handstand pushup device of claim 3, wherein the inner surfaces of the elongate blocks are perpendicular to the upper surfaces of their respective handplate.

5. The handstand pushup device of claim 1, wherein the central body portion and the two handplates are formed by a single rigid planar base, and the padded cushion is mounted on the central body portion of the rigid planar base.

6. The handstand pushup device of claim 1, wherein each of the handplates has a pair of locking bores that form the first interlocking feature, and each of the elongate blocks includes a pair of locking posts extending from its bottom surface, the pair of locking posts being sized, shaped, and positioned to frictionally fit into the locking bores for removably mounting the elongate blocks on the handplates.

7. The handstand pushup device of claim 1, wherein the elongate blocks are in the form of a rectangular cuboid.

8. The handstand pushup device of claim 7, wherein the inner surface of each of the elongate blocks is a smooth, unbroken surface.

9. A handstand pushup device comprising:

a generally rectangular rigid planar base having a central body portion and two handplates that are positioned laterally on opposite sides of the central body portion, each of the handplates having a flat upper surface that is slip resistant;

a padded cushion mounted on the central body portion;

a plurality of stacked plates that each include nesting posts and nesting bores that interlock when the stacked plates are stacked on top of one of the handplates and each other, with further handplates being formed by a top surface of a top one of the plurality of stacked plates;

a first interlocking feature formed in each of the handplates, and also formed in each of the stackable plates that may be mounted on each of the handplates;

two elongate blocks, each of the elongate blocks having a bottom surface and an inner surface, the bottom surface having a second interlocking feature that interlocks with the first interlocking feature of one of the handplates, or the further handplates, for removably mounting the elongate block on the handplate such that the inner surfaces of the elongate blocks are parallel and placed a predetermined distance from each other; and wherein the elongate blocks are mounted on the handplates such that the inner surfaces of the elongate blocks are parallel and placed a predetermined distance from each other.

10. The handstand pushup device of claim 9, wherein the inner surfaces of the elongate blocks are spaced a distance of about 30 inches from each other when mounted on the handplates.

11. The handstand pushup device of claim 9, wherein the inner surfaces of the elongate blocks are perpendicular to the upper surfaces of their respective handplate.

12. The handstand pushup device of claim 9, wherein each of the handplates has a pair of locking bores that form the first interlocking feature, and each of the elongate blocks includes a pair of locking posts which frictionally fit into the locking bores for removably mounting the elongate blocks on the handplates.

13. The handstand pushup device of claim 12, wherein each of the handplates comprises three pairs of locking bores, an inner pair, a middle pair, and an outer pair, each of which is able to mount one of the elongate blocks at different distances from the padded cushion such that the inner surfaces of the two elongate blocks are parallel to each other.

14. The handstand pushup device of claim 9, wherein the elongate blocks are in the form of a rectangular cuboid.

15. A method of performing handstand pushups, the method comprising the steps of:

providing a handstand pushup device comprising:

a central body portion comprising a padded cushion;

two handplates, positioned laterally on opposite sides of the central body portion, each of the handplates having a flat upper surface that is slip resistant;

a first interlocking feature formed in each of the handplates; and two elongate blocks, each of the elongate blocks having a bottom surface and an inner surface, the bottom surface having a second interlocking feature that interlocks with the first interlocking feature of one of the handplates;

mounting each of the elongate blocks on one of the handplates such that the inner surfaces of the elongate blocks limit the placement of a user's hands while performing handstand pushups using the device, so that the user's hands are not placed too far apart when performing the handstand pushups;

performing a handstand such that the user's hands are placed on the handplates, his or her head is placed on the padded cushion, and his or her body and legs extend generally vertically into the air, and further such that the inner surfaces of the elongate blocks prevent the user from spreading his hands too far apart on the handplates; and pushing with his or her hands to life his or her body upwardly to raise his or her head off of the padded cushion.

* * * * *